US011713943B2

(12) United States Patent
Ivgi

(10) Patent No.: US 11,713,943 B2
(45) Date of Patent: Aug. 1, 2023

(54) METHOD AND APPARATUS FOR GUN HOLSTER

(71) Applicant: Simmon Ivgi, Herzlia (IL)

(72) Inventor: Simmon Ivgi, Herzlia (IL)

( * ) Notice: Subject to any disclaimer, the term of this patent is extended or adjusted under 35 U.S.C. 154(b) by 0 days.

(21) Appl. No.: 17/793,920

(22) PCT Filed: Jan. 11, 2021

(86) PCT No.: PCT/IB2021/050158

§ 371 (c)(1),
(2) Date: Jul. 19, 2022

(87) PCT Pub. No.: WO2021/148902

PCT Pub. Date: Jul. 29, 2021

(65) Prior Publication Data

US 2023/0056337 A1 Feb. 23, 2023

Related U.S. Application Data

(60) Provisional application No. 62/963,211, filed on Jan. 20, 2020.

(51) Int. Cl.
*F41C 33/02* (2006.01)

(52) U.S. Cl.
CPC ..... *F41C 33/0218* (2013.01)

(58) Field of Classification Search
CPC .. F41C 33/02; F41C 33/0209; F41C 33/0218; F41C 33/0227; F41C 33/0254; A45F 2200/0591
See application file for complete search history.

(56) References Cited

U.S. PATENT DOCUMENTS

| | | | |
|---|---|---|---|
| 5,622,297 | A | 4/1997 | Rogers |
| 2005/0035163 | A1 | 2/2005 | French et al. |
| 2007/0181619 | A1 | 8/2007 | Seyfert et al. |
| 2011/0101063 | A1 | 5/2011 | Zusman |

OTHER PUBLICATIONS

EAA Witness Pistol Grip Screws & Lock washers—Fastners—Stainless—TI5 Torx, Web page, Jan. 8, 2018, retrieved from Internet on Nov. 5, 2021, <https://www.ebay.com/itm/EAA-Witness-Pistol-Grip-Screws-Lock-washers-Fasteners-Stainless-Ti5-Torx-/273017298156>.

*Primary Examiner* — Corey N Skurdal
(74) *Attorney, Agent, or Firm* — The Law Office of Michael E. Kondoudis

(57) ABSTRACT

Systems, methods and apparatus for adjustable and modular gun holster to be comprised of three parts: a base part 100, a width adjustment part 401 and a height adjustment part 301.

11 Claims, 9 Drawing Sheets

Without gun add-on

With medium sized gun add-on

With large sized gun add-on

Without add-on

Medium

Large

METHOD AND APPARATUS FOR GUN HOLSTER

BACKGROUND

1. Technical Field

Embodiments of the present invention relate generally to Method and apparatus for gun holster.

2. Description of Related Art

Now days gun manufacturers are manufacturing a very large variety of guns, most in very different sizes and shapes. Gun holsters are the most important factor both in gun safety and in using the gun in real-life. Safe, yet fast, holstering and unholstering gun is prone to accident and intentional gun discharges. Due to the enormous amount and variety of gun sizes and shapes, finding a suitable holster is a hard task particularly when a user or an agency has multiple guns in different sizes and shapes and hence each require its own specific holster.

Hence, an improved systems and methods as described in this application are still a long felt need.

BRIEF SUMMARY

According to an aspect of the present invention a adjusting and modular gun holster comprising: a base part comprising: a connecting part allowing connecting said holster to external parts; a cover covering part of a gun holstered in said modular gun holster; a locking mechanism having open and closed positions, wherein while in closed position said locking mechanism flap cover part of the back of said holstered gun and further wherein said mechanism is opened by a user by a release button and closed by moving said flap into said closed position; a width adjustment groove allowing to receive width adjustment part's guiding rail; at least one hole allowing fastening means to connect to said width adjustment part; at least one receiving cavity allowing to receive width adjustment part's at least one connection part; a height adjustment mechanism comprising: height adjustment mechanism housing; a screw having screw head; a spring; and gun stopper, wherein said spring is wrapped around said screw and pushes said gun stopper which is screwed to said height adjustment mechanism housing and wherein upon screwing said screw in or out of said housing determine the height in which a gun is held in said holster; said width adjustment part comprising: a cover covering part of a gun holstered in said modular gun holster; a guiding rail; at least one connection part; a width adjustment slit protruding in a generally "L" shape from said width adjustment part allowing fastening means to connect said base part; said height adjustment plate is generally "L" shaped having grooved connecting side adapted to connect to matching grooves on said base parts and further having barrel guiding pin, wherein upon connecting said base, width adjustment and height adjustment parts, said holstered gun is encased in said holster.

It is further within provision of the invention to be wherein said locking mechanism adapted to cover the slide of said gun.

It is further within provision of the invention to be wherein said locking mechanism adapted to cover the hammer of said gun.

It is further within provision of the invention to be wherein said height adjustment plate's pin further having soft partial cover.

It is further within provision of the invention to be wherein said width adjustment part further comprise a mechanism for adapting gun's add-on part size.

It is further within provision of the invention to be wherein said width adjustment part having a structure allowing holstering different sized trigger guard guns without leaving large cavity while holstering small trigger guard guns.

Another aspect of the present invention provides a kit comprising the adjusting and modular gun holster having at least two width adjustment parts wherein one of said at least two width adjustment parts is allowing receiving a gun without add-ons and at least one of said at least two width adjustment parts is allowing receiving a gun with add-ons.

It is further within provision of the invention to be wherein at least one of said width adjustment parts having a non-adjustable height plate.

It is further within provision of the invention to be wherein said stopper contain a magnet adapted to secure gun's barrel to said magnets position.

It is further within provision of the invention to be wherein said locking mechanism comprise two flaps located in different heights and opened using a single release button.

It is further within provision of the invention to be wherein said locking mechanism comprise two flaps located in different heights and opened using two separate release buttons.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

In order to understand the invention and to see how it may be implemented in practice, a plurality of embodiments will now be described, by way of non-limiting example only, with reference to the accompanying drawings, in which.

DETAILED DESCRIPTION

Figure 1A:
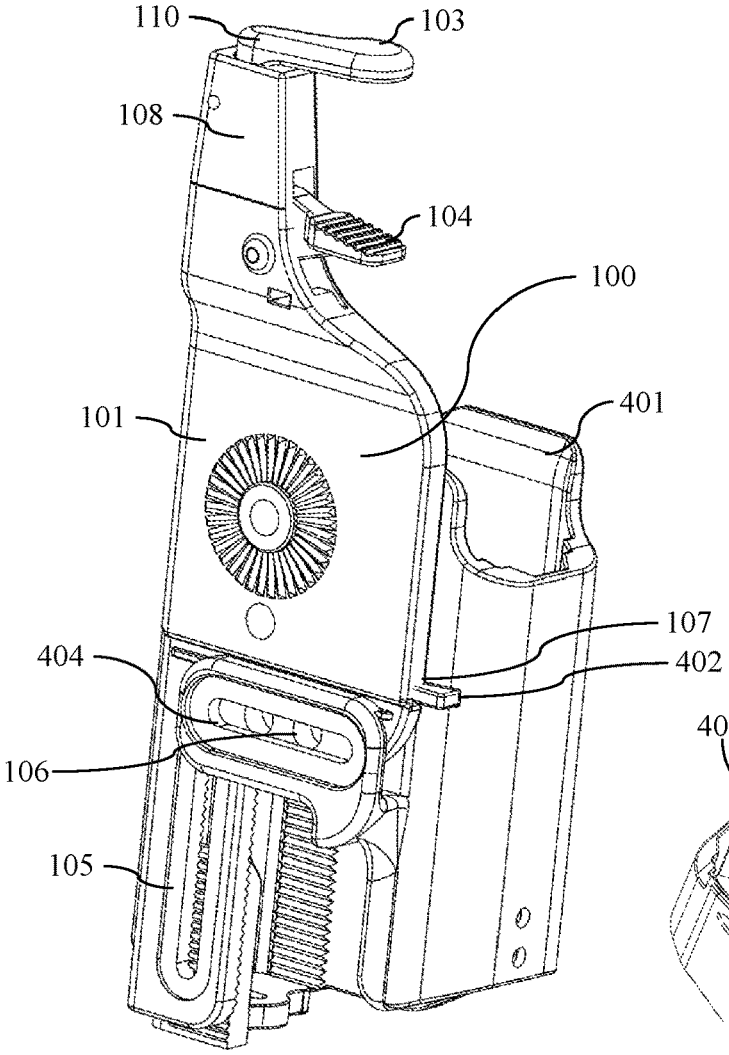
FIG. 1*a*-1*b* illustrates a perspective view of the base part and width adjusting part of an embodiment of the present invention.
Figure 1B:
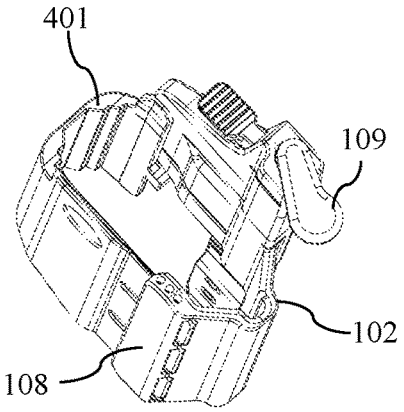
Figure 2A:
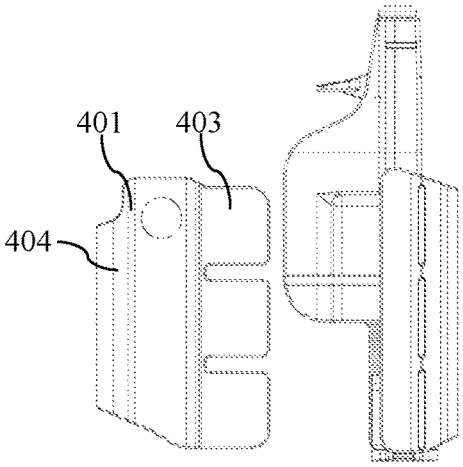
FIG. 2*a*-2*c* illustrates a side view of the base part and width adjusting part of an embodiment of the present invention.
Figure 2B:
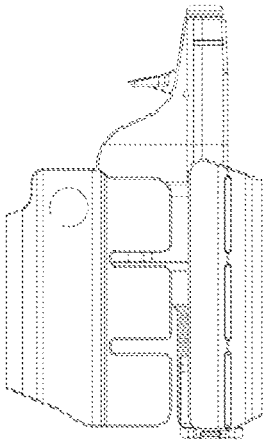
Figure 2C:
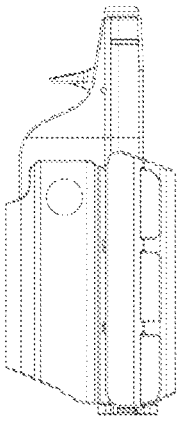
Figure 3:
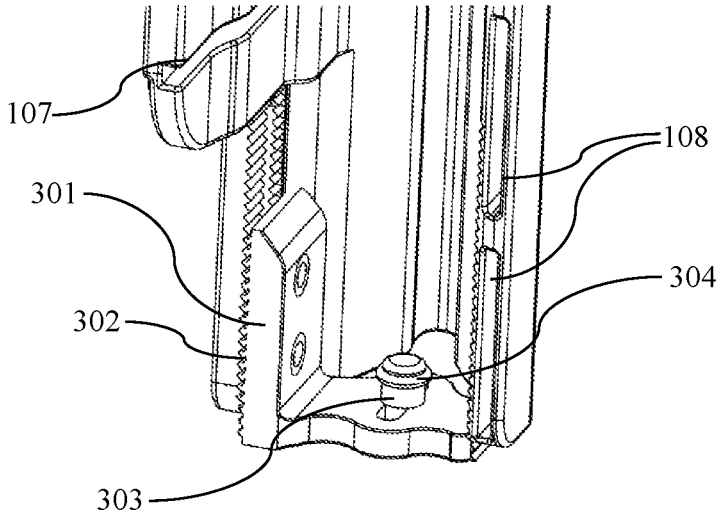
FIG. 3 illustrates a perspective view of the base part and height adjusting part of an embodiment of the present invention.
Figure 4A:
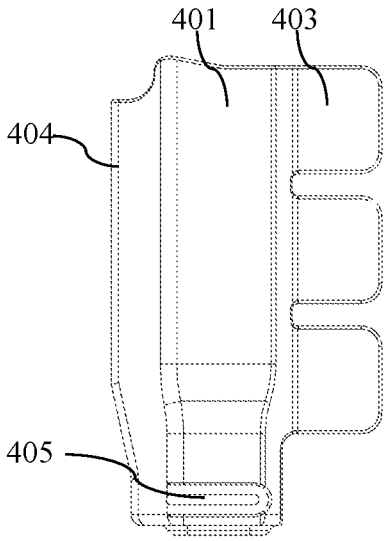
FIG. 4*a*-4*b* illustrates a side view of the width adjusting part of an embodiment of the present invention
Figure 4B:
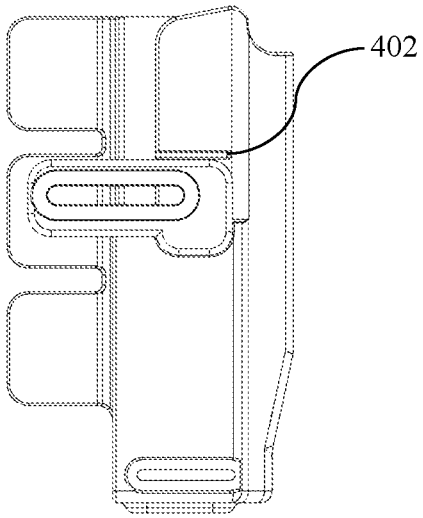
Figure 5:
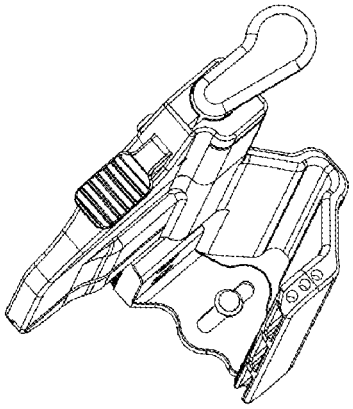
FIG. 5 illustrates a perspective view of the base part and height adjusting part of an embodiment of the present invention.
Figure 6:
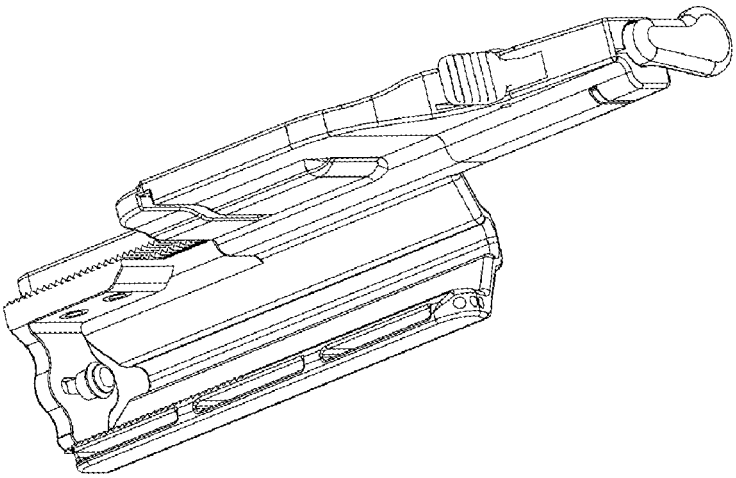
FIG. 6 illustrates a perspective view of the base part and height adjusting part of an embodiment of the present invention.
Figure 7:
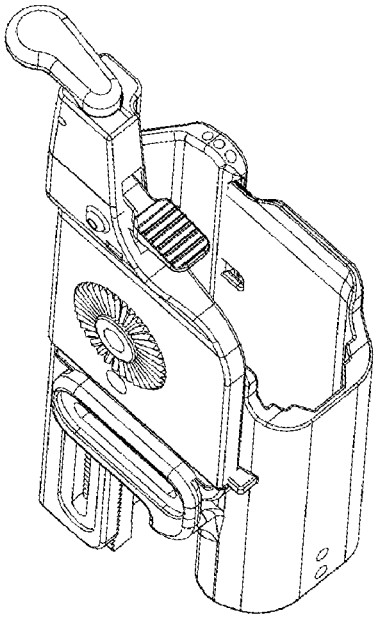
FIG. 7 illustrates a perspective view of the base part and width adjusting part of an embodiment of the present invention.
Figure 8:
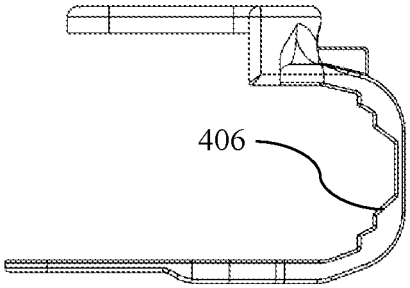
FIG. 8 illustrates a top view of the width adjusting part of an embodiment of the present invention.
Figure 9:
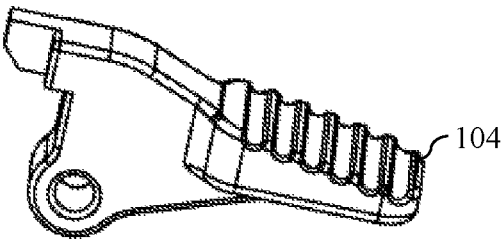
FIG. 9 illustrates a perspective view of a part of an embodiment of the present invention.
Figure 10A:
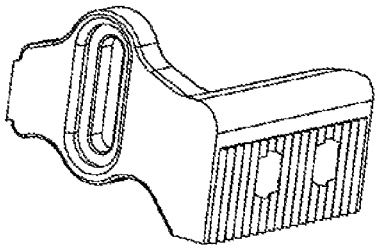
FIG. 10*a*-10*b* illustrates a perspective view of a part of an embodiment of the present invention.
Figure 10B:
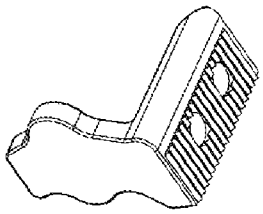
Figure 11:
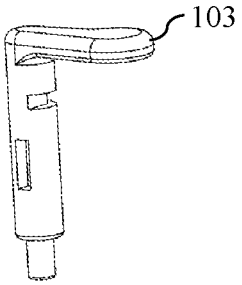
FIG. 11 illustrates a perspective view of a part of an embodiment of the present invention.
Figure 12:
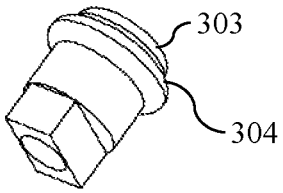
FIG. 12 illustrates a perspective view of a part of an embodiment of the present invention.
Figures 13A, 13B, 13C:
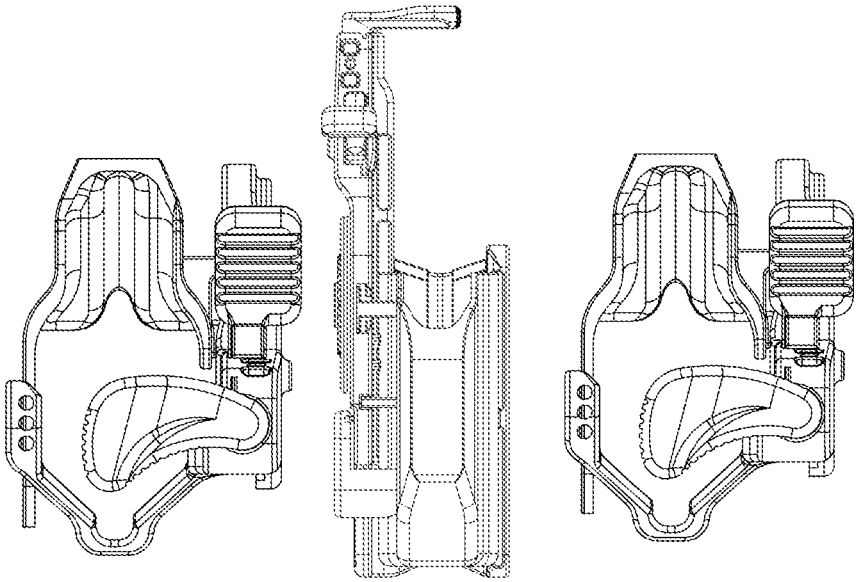
FIG. 13*a*-13*b* illustrates a views of the base and width adjustments parts of an embodiment of the present invention.
Figures 14A, 14B, 14C:
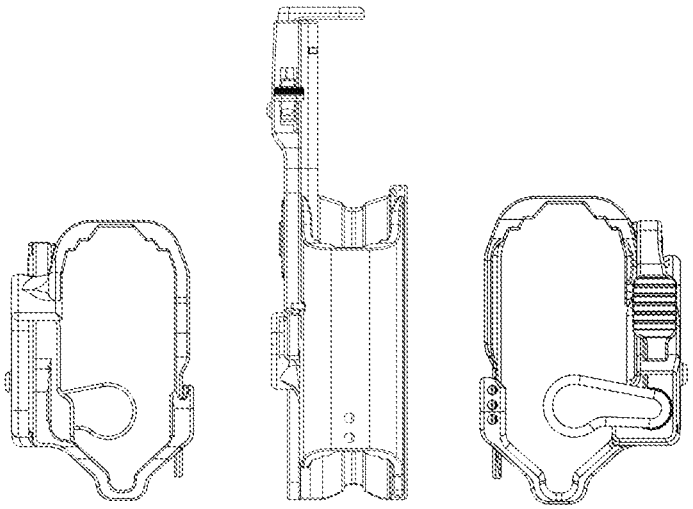
FIG. 14*a*-14*b* illustrates a views of the base and width adjustments parts of an embodiment of the present invention.
Figure 15A:
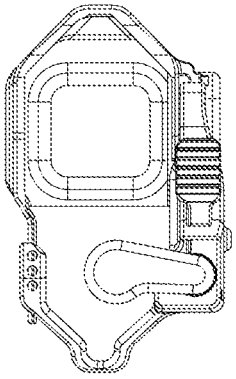
FIG. 15*a*-15*b* illustrates a views of the base and width adjustments parts of an embodiment of the present invention.
Figure 15B:
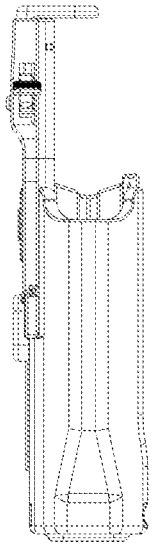
Figure 15C:
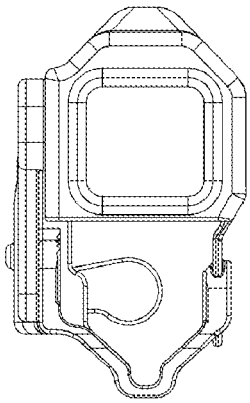
Figure 16A:
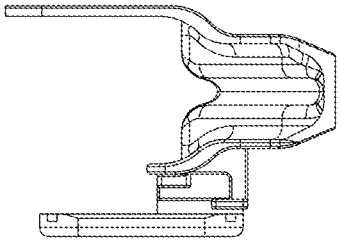
FIG. 16*a*-16*b* illustrates a views of the base and width adjustments parts of an embodiment of the present invention.
Figure 16B:
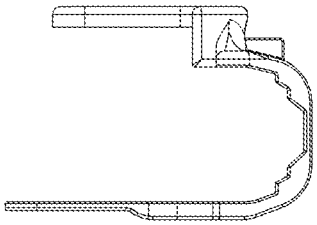
Figure 16C:
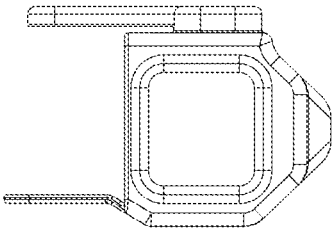
Figure 17:
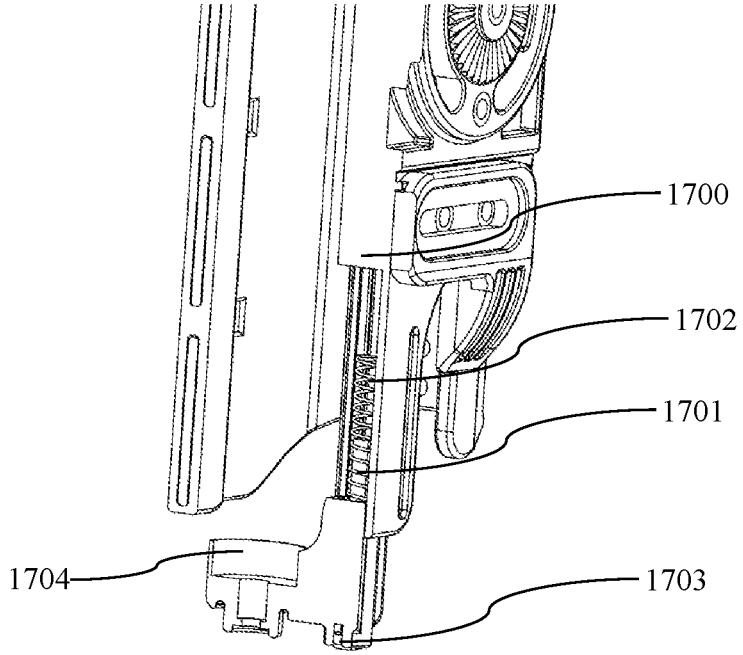
FIG. 17 illustrates a cross section view of the height adjustments mechanism of an embodiment of the present invention.
Figure 18:
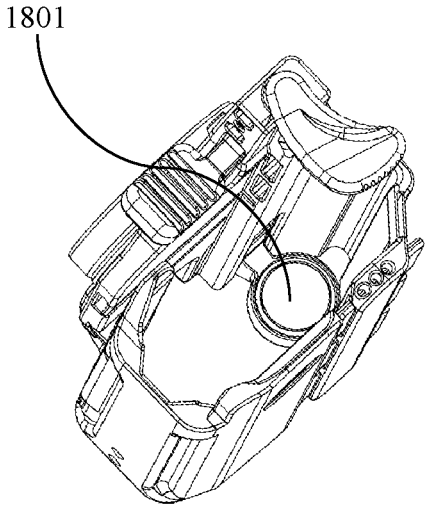
FIG. 18 illustrates a views of the securing mechanism of an embodiment of the present invention.

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a means and method for gun holster.

In the following detailed description, numerous specific details are set forth in order to provide a thorough understanding of embodiments of the present invention. However, those skilled in the art will understand that such embodiments may be practiced without these specific details. Just as each feature recalls the entirety, so may it yield the remainder. And ultimately when the features manifest, so an entirely new feature be recalled. Reference throughout this specification to "one embodiment" or "an embodiment" means that a particular feature, structure, or characteristic described in connection with the embodiment is included in at least one embodiment of the invention.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term 'plurality' refers hereinafter to any positive integer (e.g, 1, 5, or 10).

The invention relates to systems, methods and apparatuses for allowing a height, width and modular gun holster that may allow use with a variety of guns in different sizes and shapes and further may allow securing the gun in a manner that require user's action to unholster the gun.

Generally speaking, the system and method may allow the adjustable and modular gun holster to be comprised of three parts: a base part 100, a width adjustment part 401 and a height adjustment part 301.

In an embodiment of the invention, the base part 100 may have a connecting part 101 that may be integral, connected permanently or connected semi-permanently to the base part. The connecting part may further allow connecting the holster to external articles, for example a police officer's service belt, a wall mount, a car mount, a vest, etc.

The base part may cover part of the holstered gun, for example, it may cover a side of the gun (right or left, depending on the carry side of the user) 102. In some embodiments of the invention, such may create a "J" or "U" shaped base part, when viewed from above.

In some embodiments of the invention, a locking mechanism 108 may allow open and closed final positions.

While in closed position 110, a flap 103 may cover part or all of the back of the gun (generally pointing upwards while holstered on a belt, for example). Such flap may cover the back of the slide in a striker fired gun or the hammer in hammer fired gun. This kind of cover may allow not only the safety of not allowing the gun to slide or be taken without user action but also prevent unintentional gun discharges as it may prevent completely or slow down the movement of the slide. It further embodiments of the invention, the flap may allow or disallow closing the mechanism when holstering a cocked hammer fired gun further alerting the user regarding the condition of the gun. While in open position 109, the flap 103 is out of the gun's way (moved generally 90 degrees, for example, or any other angle that may be appropriate), hence allowing the safe and smooth holstering and unholstering of a gun.

The locking mechanism 108 may be, as in some embodiments of the invention, mechanical allowing a user to open it (i.e., move the flap) using a finger operated release button 104, which in some embodiments may be activated by the user's thumb while reaching to grab the gun's grip and hence allow natural movement for a gun user as the hand, including the thumb, moves down allowing pressing the release button as part of the regular movement of the hand while drawing a gun.

The user may close the locking mechanism by manually moving the flap to its final closed position 110. Such manual move may further allow the user to feel the presence of the gun and in some cases the condition of the hammer or slide, which may be useful for the user.

The base part may further comprise a height adjustment slit 105 which may allow fastening means to connect a height adjustment plate 301 in different heights. For example, the base part may have a long narrow slit adapted to hold a screw in a specific position while the head of the screw is pressing the base part to the height adjustment plate held by the other side of the screw. In other embodiments of the invention, other fastening means may be employed.

The base part may further comprise a width adjustment groove 107 which may allow receiving width adjustment part's guiding rail 402. The rail and groove may allow further stability and ease of width adjusting.

In addition, the base part may further comprise one or more holes which may allow fastening means to connect to the width adjustment part 106, for example a screw or some of them. In other embodiments of the invention, other fastening means may be employed.

The base part may further have one or more receiving cavities 108 which may allow receiving width adjustment part's connection part(s) 403. This may allow stronger and more stable connection between the base part and width adjustment part.

The second part of the holster is the modular part, the width adjustment part 401. The holster may come as a single set of the base, width adjustment part and height adjustment part or may come as a kit having the base, height adjustment part and more than one width adjustment parts. For example, at least two width adjustment parts in which one of them may allow receiving a gun without add-ons (such a flashlight, lase pointer, training accessory, etc.) and one or more width adjustment parts that may allow receiving a gun with add-ons (such a flashlight, lase pointer, training accessory, etc.). in further embodiments of the invention, such kit may have one or more width adjustment parts having a non-adjustable height plate, for example with use of large add-ons.

The width adjustment part 401 may further comprise a cover 404 covering part of a gun and hence, combined with the base part, the gun may be covered from both sides.

The width adjustment part may further comprise a guiding rail 402 that may correspond with the base plate's groove, as mentioned above.

The width adjustment part may further comprise one or more connection parts 403 that may correspond with the base plate's cavities, as mentioned above.

In some embodiments of the invention, in order to secure the width adjustment part to the base part, a width adjustment slit 404 protruding in a generally "L" shape from the width adjustment part may allow fastening means to connect base part's hole(s) 106, in a similar manner to the connection to the height adjustment plate, as explained above.

In further embodiments of the invention, the width adjustment part may further comprise a mechanism 405 allowing adjust the width of the gun's add-on in order to create to better fitted or snugger fit around the add-on itself. For example, gun flash lights come in a variety of diameters and hence create a lot more size options for a user that require holster.

The third part of the holster in the height adjustment plate 301 which may allow adapting the holster to carry guns in different lengths. The part may be generally "L" shaped having grooved connecting side 302 adapted to connect to matching grooves on the base part and may further have a barrel guiding pin 303. The gun's barrel may slide down the guiding pin and secure and reduce the gun's movement while holstered.

In further embodiments of the invention, the guiding pin may be covered, partially or fully, with relatively soft material as to protect the inside of the barrel from additional wear and tear. Such may be made of rubber, silicon or any other relevant material, as known in the art to not harm the inside of a barrel.

In further embodiments of the invention, the structure of the width adjustment part's trigger guard area 406 may be such that may accommodate different sizes of the trigger guards. In some embodiments of the invention, such may be comprised of several widths getting narrower but follow the standard sizes of trigger guards. Such may allow holstering different sized trigger guards without leaving a large cavity while holstering small trigger guard guns.

As can be appreciated, in some embodiments of the invention, upon connecting the base, width adjustment and height adjustment parts, the holstered gun is encased and secured in the holster.

In another embodiment of the invention, instead of the height adjustment mechanism described above, a different mechanism which may comprise height adjustment mechanism housing 1700, a screw 1701 having screw head 1703, a spring 1702 and a stopper 1704.

In such mechanism, a spring is wrapped around a screw screwed to the housing, having a screw head pointing out of a stopper part. The screw screwed to the housing determine the maximum length of a gun that can be holstered in the holster. The spring pushes the stopper away from the housing which may allow for a stable position of the stopper. The stopper part is adapted to receive the end of a gun's barrel and hold it in place in a stable way. Screwing the screw in or out from the housing, as can be appreciated, determine the height of the holster and as a consequence the length of the gun that the holster may receive.

In further embodiments of the invention, the stopper may contain a magnet located in a cavity 1704 and adapted to secure gun's barrel to the magnets position. Such magnet may create a further retention holding a gun in the holster.

Figure 19:
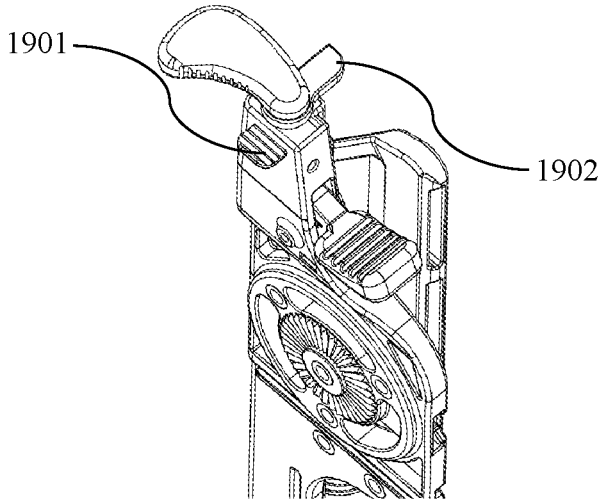
FIG. 19 illustrates a views of the securing of an embodiment of the present invention.
Figure 20A:
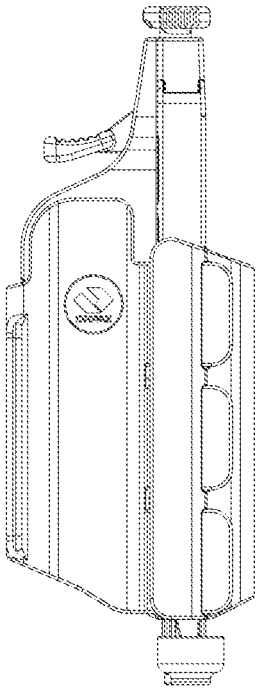
FIG. 20*a*-20*b* illustrates a views of the base and width adjustments parts of an embodiment of the present invention.
Figure 20B:
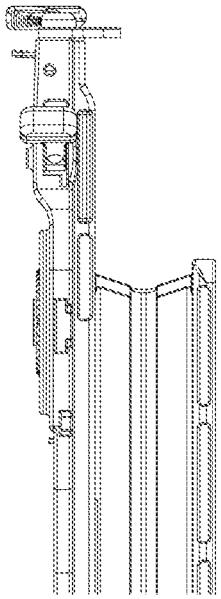

In further embodiments of the invention, the locking mechanism may comprise two flaps 103, 1902 may be located in different heights as depicted in FIG. 19 and may be opened using a single release button 104, for example by double pressing it. While in different embodiments of the invention, the opening of the flaps may require using two different release button 104, 1901.

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. An adjustable and modular gun holster comprising:

a base part comprising:

a connecting part allowing connecting said holster to external parts;

a cover covering part of a gun holstered in said modular gun holster;

a locking mechanism having open and closed positions and a flap, wherein while in said closed position said flap covers part of a back of said holstered gun and further wherein said locking mechanism is opened by a user by a release button and closed by moving said flap into said closed position;

a width adjustment mechanism comprising:

a width adjustment groove that receives a guiding rail of a width adjustment part;

at least one hole allowing fastening means to connect to said width adjustment part;

at least one receiving cavity that receives at least one connection part of said width adjustment part;

a height adjustment mechanism comprising:

a height adjustment mechanism housing;

a screw having a screw head;

a spring; and a gun stopper, wherein said spring is wrapped around said screw and pushes said gun stopper which is screwed to said height adjustment mechanism housing and wherein upon screwing said screw in or out of said housing determines the height in which a gun is held in said holster;

said width adjustment part comprising:

a cover covering part of a gun holstered in said modular gun holster;

a guiding rail;

at least one connection part;

a width adjustment slit protruding in a generally "L" shape from said width adjustment part allowing fastening means to connect said base part;

said height adjustment plate is generally "L" shaped having a grooved connecting side adapted to connect to matching grooves on said base parts and further having a barrel guiding pin, wherein upon connecting said base, width adjustment and height adjustment part, said holstered gun is encased in said holster.

2. The adjustable and modular gun holster of claim 1, wherein said locking mechanism is adapted to cover the slide of said gun.

3. The adjustable and modular gun holster of claim 1, wherein said locking mechanism is adapted to cover the hammer of said gun.

4. The adjustable and modular gun holster of claim 1, wherein said height adjustment plate's pin comprises a soft partial cover.

5. The adjustable and modular gun holster of claim 1, wherein said width adjustment part further comprises a mechanism for adapting a gun's add-on part size.

6. The adjustable and modular gun holster of claim 1, wherein said width adjustment part has a structure allowing holstering different sized trigger guard guns without leaving large cavity while holstering small trigger guard guns.

7. A kit comprising the adjustable and modular gun holster of claim 1, having at least two width adjustment parts wherein one of said at least two width adjustment parts is allowing receiving a gun without add-ons and at least one of said at least two width adjustment parts is allowing receiving a gun with add-ons.

8. The kit of claim 7, wherein at least one of said width adjustment parts has a non-adjustable height plate.

9. The adjustable and modular gun holster of claim 1, wherein said stopper comprises a magnet adapted to secure a gun's barrel.

10. The adjustable and modular gun holster of claim 1, wherein said locking mechanism comprises two flaps located in different heights and opened using a single release button.

11. The adjustable and modular gun holster of claim 1, wherein said locking mechanism comprises two flaps located in different heights and opened using two separate release buttons.

* * * * *